US009103308B2

(12) United States Patent
Serra et al.

(10) Patent No.: US 9,103,308 B2
(45) Date of Patent: Aug. 11, 2015

(54) COUPLING DEVICE

(75) Inventors: Giandomenico Serra, Loc. Ghezzano-S. Giuliano Terme (IT); Gisella Di Domizio, San Giuliano Terme (IT); Edoardo Giorgetti, Rosignano Marittimo (IT); Daniel Marc, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 521 days.

(21) Appl. No.: 13/515,025

(22) PCT Filed: Nov. 17, 2010

(86) PCT No.: PCT/EP2010/067690

§ 371 (c)(1),
(2), (4) Date: Jul. 19, 2012

(87) PCT Pub. No.: WO2011/069789

PCT Pub. Date: Jun. 16, 2011

(65) Prior Publication Data

US 2012/0280067 A1 Nov. 8, 2012

(30) Foreign Application Priority Data

Dec. 9, 2009 (EP) ..... 09015261

(51) Int. Cl.
*F02M 61/14* (2006.01)
*F02M 55/02* (2006.01)
(Continued)

(52) U.S. Cl.
CPC ..... *F02M 61/14* (2013.01); *F02M 55/025* (2013.01); *F02M 55/04* (2013.01); *F02M 69/465* (2013.01); *F02M 2200/306* (2013.01); *F02M 2200/9015* (2013.01)

(58) Field of Classification Search
CPC ..... F02M 61/14; F02M 61/168; F02M 2200/858; F02M 55/02; F02M 55/004; F02M 55/005; F16F 1/328; F16F 1/32
USPC ..... 123/456, 468, 469, 470
See application file for complete search history.

(56) References Cited

U.S. PATENT DOCUMENTS 3,857,573 A * 12/1974 Pugh ..... 277/598
4,575,114 A 3/1986 Camp ..... 280/124.152
(Continued)

FOREIGN PATENT DOCUMENTS

DE 102005008038 A1 8/2006 ..... F02M 55/02
EP 2333301 A1 6/2011 ..... F02M 55/02
(Continued)

OTHER PUBLICATIONS

European Search Report and Written Opinion for Application No. 09 015 261.2 (8 pages), Jun. 9, 2010.
(Continued)

*Primary Examiner* — Thomas Moulis
(74) *Attorney, Agent, or Firm* — Slayden Grubert Beard PLLC

(57) ABSTRACT

A coupling device for mechanically coupling a fuel rail to a cylinder head of a combustion engine comprises a fuel injector cup designed to be hydraulically and mechanically coupled to the fuel rail and comprising a through hole extending between a first surface and a second surface of the fuel injector cup, the second surface arranged to face the cylinder head, and a fastening element designed to be fixedly coupled to the cylinder head, the fastening element comprising a head portion facing the first surface of the fuel injector cup and a shank portion partially arranged in the through hole and designed to be in engagement with the cylinder head. The coupling device comprises a first spring element arranged axially between the head portion and the first surface of the fuel injector cup, and a second spring element facing the second surface of the fuel injector cup and arrangeable axially between the second surface of the fuel injector cup and the cylinder head.

20 Claims, 3 Drawing Sheets

(51) Int. Cl.
*F02M 55/04* (2006.01)
*F02M 69/46* (2006.01)

(56) References Cited

U.S. PATENT DOCUMENTS

| | | | | | |
|---|---|---|---|---|---|
| 4,938,193 | A * | 7/1990 | Raufeisen et al. | 123/470 |
| 5,056,975 | A * | 10/1991 | Ando | 411/155 |
| 5,080,335 | A | 1/1992 | Solleder et al. | 267/141.4 |
| 5,697,345 | A * | 12/1997 | Genter et al. | 123/470 |
| 5,743,509 | A * | 4/1998 | Kanda et al. | 248/635 |
| 6,318,341 | B1 * | 11/2001 | Gmelin et al. | 123/470 |
| 6,640,784 | B1 * | 11/2003 | Sims, Jr. | 123/470 |
| 7,516,735 | B1 * | 4/2009 | Doherty et al. | 123/468 |
| 7,591,246 | B2 * | 9/2009 | Beardmore et al. | 123/456 |
| 8,245,697 | B2 * | 8/2012 | Biasci et al. | 123/470 |
| 8,454,290 | B2 * | 6/2013 | Schaser et al. | 411/544 |
| 8,844,502 | B2 * | 9/2014 | Solferino et al. | 123/470 |
| 8,875,681 | B2 * | 11/2014 | Kannan | 123/456 |
| 2004/0020469 | A1 * | 2/2004 | Reiter et al. | 123/470 |
| 2004/0069280 | A1 * | 4/2004 | Evancik et al. | 123/470 |
| 2006/0048753 | A1 * | 3/2006 | Kashima | 123/470 |
| 2007/0163545 | A1 | 7/2007 | Beardmore et al. | 123/456 |
| 2008/0075403 | A1 | 3/2008 | Holt et al. | 384/551 |
| 2014/0261332 | A1 * | 9/2014 | Ramamurthy et al. | 123/470 |

FOREIGN PATENT DOCUMENTS

| | | | | |
|---|---|---|---|---|
| JP | 2003286928 | A | 10/2003 | F02D 9/10 |
| WO | 2011/069789 | A1 | 6/2011 | F02M 55/02 |

OTHER PUBLICATIONS

Chinese Office Action, Application No. 201080056207.0, 13 pages, Jan. 6, 2014.

* cited by examiner

COUPLING DEVICE

CROSS-REFERENCE TO RELATED APPLICATIONS

This application is a U.S. National Stage Application of International Application No. PCT/EP2010/067690 filed Nov. 17, 2010, which designates the United States of America, and claims priority to EP Application No. 09015261.2 filed Dec. 9, 2009, the contents of which are hereby incorporated by reference in their entirety.

TECHNICAL FIELD

This disclosure relates to a coupling device for hydraulically and mechanically coupling a fuel rail to a cylinder head of a combustion engine.

BACKGROUND

Coupling devices for hydraulically and mechanically coupling a fuel rail to a cylinder head of a combustion engine are in widespread use, in particular for internal combustion engines. Fuel can be supplied to an internal combustion engine by the fuel rail through a fuel injector. The fuel rail can be coupled to the cylinder head in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail. Known fuel rails comprise a hollow body with recesses in form of fuel injector cups, wherein the fuel injectors are arranged.

SUMMARY

In one embodiment, a coupling device for mechanically coupling a fuel rail to a cylinder head of a combustion engine comprises: a fuel injector cup being designed to be hydraulically and mechanically coupled to the fuel rail and comprising a through hole extending between a first surface and a second surface of the fuel injector cup, the second surface opposing the first surface and being arranged and designed to face the cylinder head, and a fastening element being designed to be fixedly coupled to the cylinder head, the fastening element comprising a head portion and a shank portion, the head portion facing the first surface of the fuel injector cup, the shank portion being partially arranged in the through hole and being designed to be in engagement with the cylinder head, wherein the coupling device comprises a first spring element being arranged axially between the head portion and the first surface of the fuel injector cup, and a second spring element facing the second surface of the fuel injector cup and being arrangeable axially between the second surface of the fuel injector cup and the cylinder head.

In a further embodiment, a distance element is arranged axially between the first spring element and the second spring element. In a further embodiment, the distance element is shaped as a sleeve and is at least partially arranged inside the through hole, and the shank portion is at least partially arranged inside the distance element. In a further embodiment, a first retaining element is arranged inside the distance element and is in engagement with the shank portion. In a further embodiment, the first retaining element comprises a plastic. In a further embodiment, a bushing is arranged to face the second spring element, the bushing being arrangeable axially between the second spring element and the cylinder head. In a further embodiment, a second retaining element is arranged inside the bushing and is in engagement with the shank portion. In a further embodiment, the second retaining element comprises a plastic. In a further embodiment, the fastening element is a screw.

BRIEF DESCRIPTION OF THE DRAWINGS

Example embodiments will be explained in more detail below with reference to figures, in which.

DETAILED DESCRIPTION

Figure 1:
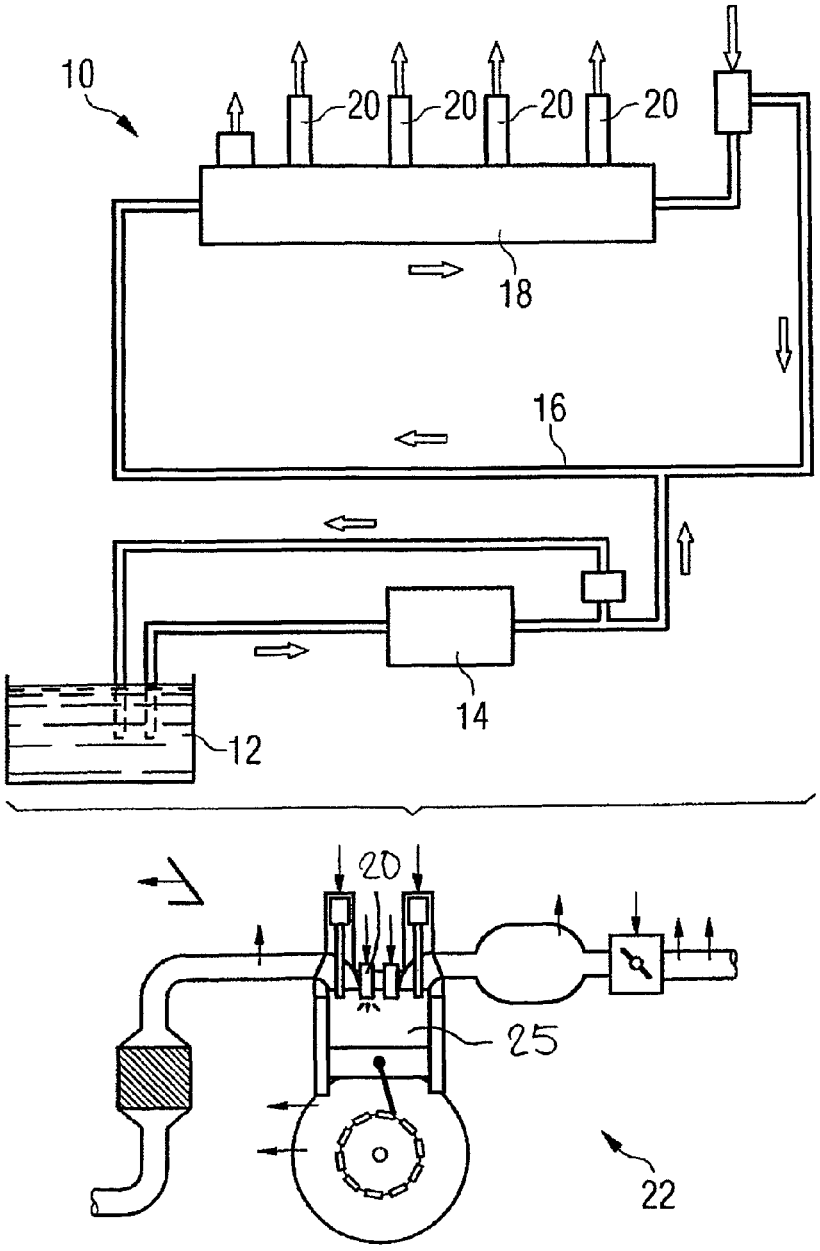
FIG. 1 an example internal combustion engine in a schematic view.

Some embodiments provide a coupling device for hydraulically and mechanically coupling a fuel rail to a cylinder head of a combustion engine which is simply to be manufactured and which facilitates a reliable and precise coupling between the fuel rail and the cylinder head.

Some embodiments provide a coupling device for mechanically coupling a fuel rail to a cylinder head of a combustion engine. The coupling device comprises a fuel injector cup being designed to be hydraulically and mechanically coupled to the fuel rail and comprising a through hole extending between a first surface and a second surface of the fuel injector cup, the second surface opposing the first surface and being arranged and designed to face the cylinder head, and a fastening element being designed to be fixedly coupled to the cylinder head. The fastening element comprises a head portion and a shank portion. The head portion faces the first surface of the fuel injector cup. The shank portion is partially arranged in the through hole and is designed to be in engagement with the cylinder head. The coupling device comprises a first spring element which is arranged axially between the head portion and the first surface of the fuel injector cup, and a second spring element which faces the second surface of the fuel injector cup and is arrangeable axially between the second surface of the fuel injector cup and the cylinder head.

This may provide the advantage of fast and secure coupling of the fuel rail to the cylinder head. Furthermore, the coupling of the fuel injector cup with the cylinder head may allow an assembly of the cylinder head and the fuel rail without a direct contact between the cylinder head and the fuel injector cup. Consequently, a noise transmission between the cylinder head and the fuel rail can be kept small. Additionally, the stiffness of the spring elements may be selected in a simple manner in view of a favorable dynamic behavior of the fuel rail relative to the cylinder head.

In one embodiment a distance element is arranged axially between the first spring element and the second spring element. By this a preset distance between the first spring element and the second spring element may be obtained. Consequently, a preset deformation of the spring elements may be obtained.

In a further embodiment the distance element is shaped as a sleeve and is at least partially arranged inside the through hole. The shank portion is at least partially arranged inside the distance element. By this a compact construction of the coupling device may be obtained.

In a further embodiment a first retaining element is arranged inside the distance element and is in engagement with the shank portion. By this the fastening element may be arranged in any desired position relative to the distance element. Consequently, an easy tightening of the fastening element may be obtained. Furthermore, a subassembly comprising the fastening element, the first spring element, the sleeve and the first retaining element can be obtained which enables an easy construction of the coupling device.

In a further embodiment the first retaining element comprises a plastic. This may provide a secure engagement between the first retaining element and the shank portion.

In a further embodiment a bushing is arranged to face the second spring element. The bushing is arrangeable axially between the second spring element and the cylinder head. In this manner a direct contact between the second spring element and the cylinder head may be avoided. The bushing may distribute the force from the coupling device to the cylinder head and the pressure between the coupling device and the cylinder head may be kept small. Consequently, an imprinting of the second spring element in a surface of the cylinder head may be avoided.

In a further embodiment a second retaining element is arranged inside the bushing and is in engagement with the shank portion. As a result a second subassembly comprising the second spring element, the bushing and the second retaining element can be obtained which is enabled to be joined with the first subassembly. Consequently, this arrangement may make it very easy to mount the fuel injector cup to the cylinder head on the production line.

In a further embodiment the second retaining element comprises a plastic. The second retaining element may thus be securely engaged with the shank portion.

In a further embodiment the fastening element is a screw. A fuel feed device 10 is assigned to an internal combustion engine 22 (FIG. 1) which can be a diesel engine or a gasoline engine. It includes a fuel tank 12 that is hydraulically connected with a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about 2,000 bar in the case of a diesel engine. Fuel injectors 20 are connected to the fuel rail 18 and the fuel is fed to the fuel injectors 20 via the fuel rail 18. The fuel injectors 20 are arranged in a cylinder head 70 of the internal combustion engine 22. In some embodiments, the fuel injectors 20 are not in direct contact with the cylinder head 70.

Figure 2:
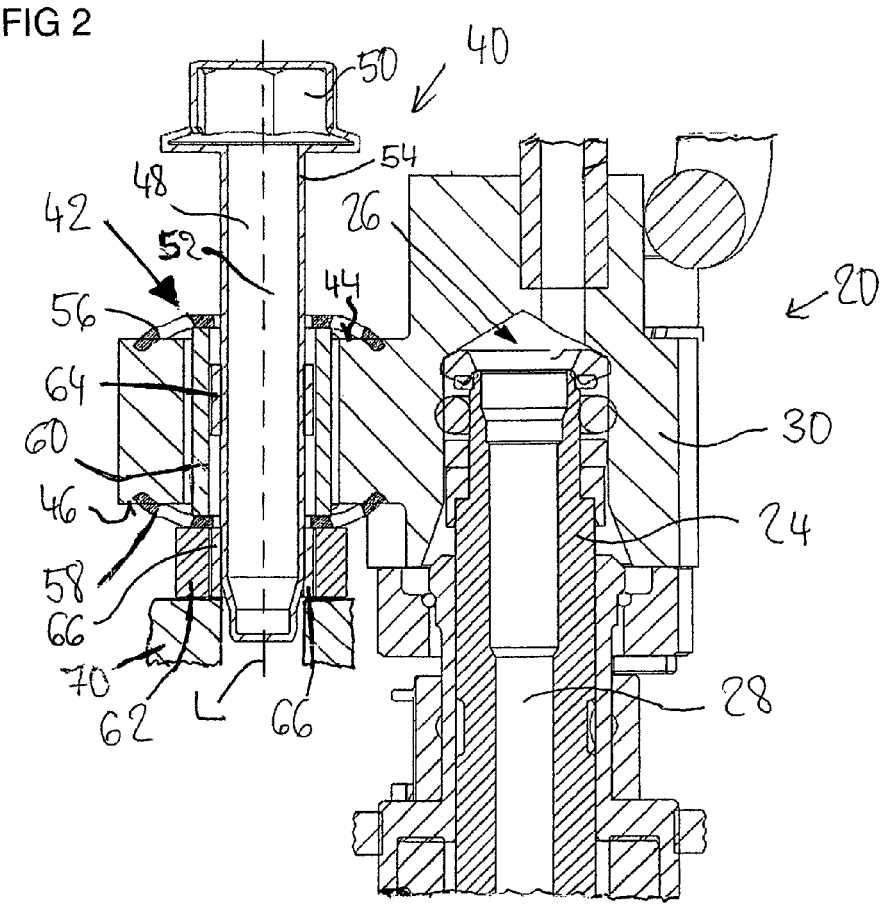
FIG. 2 an example coupling device in a longitudinal sectional view, according to an example embodiment, FIG. 3 parts of the example coupling device in a perspective view, FIG. 4 parts of the example coupling device in a perspective view, FIG. 5 parts of the example coupling device in a perspective view, and FIG. 6 parts of the example coupling device in a perspective view.

FIG. 2 shows a part of the fuel injector 20. The fuel injector 20 has a fuel injector body 24. The fuel injector 20 is suitable for injecting fuel into a combustion chamber 25 of the internal combustion engine 22 (FIG. 1). The fuel injector 20 comprises a fuel inlet portion 26. Furthermore, a cavity 28 is arranged in the fuel injector body 24. In an injection mode fuel can flow from the fuel inlet portion 26 to the cavity 28 and can be subsequently injected into the combustion chamber 25. In a non-injecting mode a fuel flow through the cavity 28 and an injection of fuel into the combustion chamber 25 is prevented.

The fuel feed device 10 comprises a fuel injector cup 30 which is part of a coupling device 40. The fuel injector cup 30 is mechanically and hydraulically coupled to the fuel rail 18. The fuel injector cup 30 is in engagement with the fuel inlet portion 26 of the fuel injector 20.

The fuel injector cup 30 has a through hole 42 with a central longitudinal axis L. The through hole 42 extends between a first surface 44 and a second surface 46 of the fuel injector cup 30. The first surface 44 is forming an outer surface of the fuel injector cup 30. The second surface 46 opposes the first surface 44 and faces the cylinder head 70.

The coupling device 40 further comprises a fastening element 48. The fastening element 48 has a head portion 50 and a shank portion 52. The head portion 50 has a larger radial extension than the shank portion 52. The head portion 50 faces the first surface 44 of the fuel injector cup 30. The fastening element 48 may be a screw with an outer thread 54. The shank portion 52 is extending through the through hole 42. The shank portion 52 can be in engagement with the cylinder head 70. If the fastening element 48 is a screw, the outer thread 54 is in engagement with an inner thread which is arranged in the cylinder head 70. By this the fastening element 48 can be fixedly coupled to the cylinder head 70.

Figure 3:
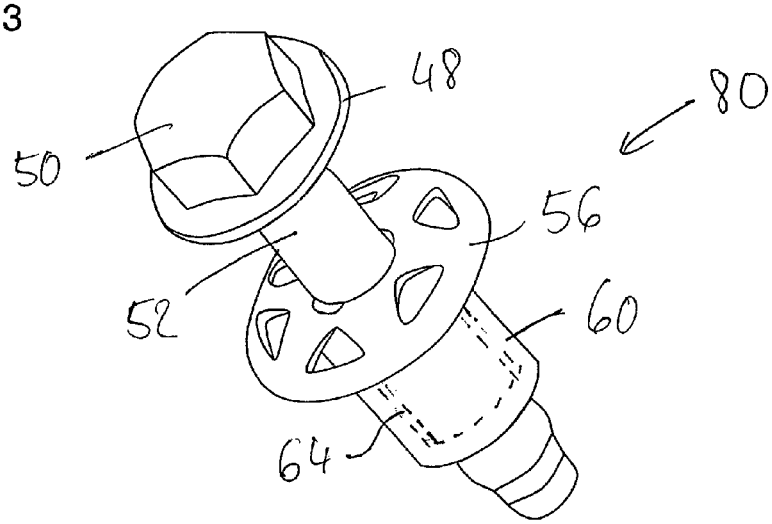
Figure 4:
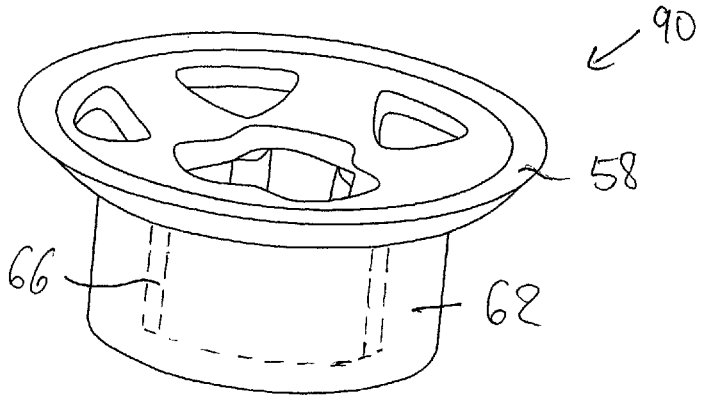
Figure 5:
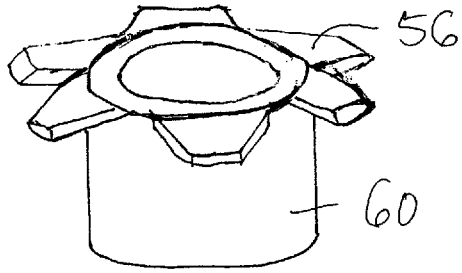

The coupling device 40 further comprises a first spring element 56 and a second spring element 58. Spring elements 56, 58 may be shaped as open-worked disks with spokes as shown in FIGS. 3 and 4. In a further embodiment, the spring elements 56, 58 are star-shaped (FIG. 5). Depending on the shape of the spring elements 56, 58 a desired stiffness of the spring elements 56, 58 can be selected. The first spring element 56 is arranged axially between the head portion 50 and the first surface 44 of the fuel injector cup 30. The second spring element 58 faces the second surface 46 of the fuel injector cup 30. The second spring element 58 is arranged axially between the second surface 46 of the fuel injector cup 30 and the cylinder head 70.

The coupling device 40 further comprises a distance element 60. The distance element 60 has the shape of a sleeve. The distance element 60 is arranged axially between the first spring element 56 and the second spring element 58. The distance element 60 enables to maintain a desired distance between the first spring element 56 and the second spring element 58. The distance is selected in a way that the deformation of the spring elements 56, 58 is in a desired range. The distance element 60 may be welded to the first spring element 56. The distance element 60 may be arranged inside the through hole 42. The shank portion 52 is arranged inside the distance element 60.

The coupling device 40 further comprises a bushing 62 which is arranged axially between the second spring element 58 and the cylinder head 70. The bushing 62 may be welded to the second spring element 58. The bushing 62 prevents the second spring element 58 to be in a direct contact with the cylinder head 70. The bushing 62 can distribute the force from the coupling device 40 to the cylinder head 70. As the bushing 62 can have a larger contact area than the second spring element 58 the pressure between the coupling device 40 and the cylinder head 70 is rather low. Therefore, it can be avoided that the second spring element 58 is imprinted into a surface of the cylinder head 70 which faces the coupling device 40.

The coupling device 40 further comprises a first retaining element 64 which is arranged inside the distance element 60. The first retaining element 64 is in engagement with the shank portion 52. The first retaining element 64 may comprise a plastic. In a further embodiment, the first retaining element 64 comprises a metal. The first retaining element 64 enables to arrange the fastening element 48 in a position relative to the distance element 60 which allows an easy tightening of the fastening element 48.

Figure 6:
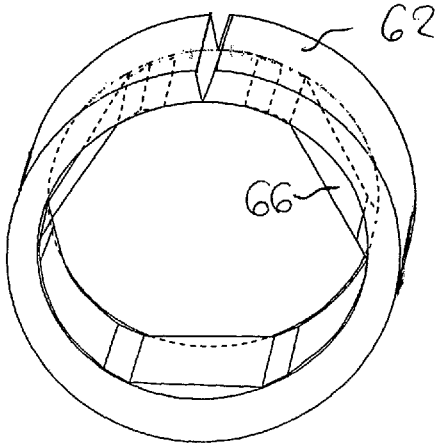

The coupling device 40 further comprises a second retaining element 66 which is arranged inside the bushing 62. The second retaining element 66 is in engagement with the shank portion 52. The second retaining element 6 may comprise a plastic. In a further embodiment, the second retaining element 66 comprises a metal. The second retaining element 66 may comprise a thin metal sheet (FIG. 6).

As shown in FIG. 3 the fastening element 48, the first spring element 56, the distance element 60 and the first retaining element 64 are composed in a manner that they form a first subassembly 80. As shown in FIG. 4 a second subassembly 90 comprises the second spring element 58, the bushing 62 and the second retaining element 66. The second subassembly 90 can be mounted with the first subassembly 80. The pre-mounted subassemblies 80, 90 make it very easy to mount the fuel injector cup 30 to the cylinder head 70 on the production line.

The presented coupling of the fuel injector cup 30 with the cylinder head 70 enables to mount the fuel injector cup 30 on the cylinder head 70 without a direct contact between the fuel injector cup 30 and the cylinder head 70. Consequently, a noise transmission between the cylinder head 70 and the fuel rail 18 can be kept small.

What is claimed is:

1. A coupling device for mechanically coupling a fuel rail to a cylinder head of a combustion engine, the coupling device comprising a fuel injector cup configured to be hydraulically and mechanically coupled to the fuel rail and comprising a through hole extending between a first surface and a second surface of the fuel injector cup, the second surface opposing the first surface and configured to face the cylinder head, a fastening element configured to be fixedly coupled to the cylinder head, the fastening element comprising a head portion and a shank portion, the head portion facing the first surface of the fuel injector cup, the shank portion being partially arranged in the through hole and configured for engagement with the cylinder head, a first spring element arranged axially between the head portion and the first surface of the fuel injector cup, a second spring element facing the second surface of the fuel injector cup and arrangeable axially between the second surface of the fuel injector cup and the cylinder head, and a bushing arranged axially between the second spring element and the cylinder head, wherein the bushing is coupled to or in contact with the second spring element such that the bushing is configured to transfer a force from the second spring element to the cylinder head.

2. The coupling device of claim 1, wherein a distance element is arranged axially between the first spring element and the second spring element.

3. The coupling device of claim 2, wherein the distance element is shaped as a sleeve and is at least partially arranged inside the through hole, and the shank portion is at least partially arranged inside the distance element.

4. The coupling device of claim 3, wherein a first retaining element is arranged inside the distance element and is in engagement with the shank portion.

5. The coupling device of claim 4, wherein the first retaining element comprises a plastic.

6. The coupling device of claim 1, wherein the bushing is fixedly coupled to the second spring element.

7. The coupling device of claim 1, wherein a retaining element is arranged inside the bushing and is in engagement with the shank portion.

8. The coupling device of claim 7, wherein the retaining element comprises a plastic.

9. The coupling device of claim 1, wherein the fastening element is a screw.

10. A combustion engine, comprising:

a fuel rail, a cylinder head, and a coupling device that mechanically couples the fuel rail to the cylinder head, the coupling device comprising:

a fuel injector cup hydraulically and mechanically coupled to the fuel rail and comprising a through hole extending between a first surface and a second surface of the fuel injector cup, the second surface opposing the first surface and facing the cylinder head, a fastening element fixedly coupled to the cylinder head and comprising a head portion and a shank portion, the head portion facing the first surface of the fuel injector cup, the shank portion partially arranged in the through hole and engaged with the cylinder head, a first spring element arranged axially between the head portion and the first surface of the fuel injector cup, a second spring element facing the second surface of the fuel injector cup and arranged axially between the second surface of the fuel injector cup and the cylinder head, and a bushing arranged axially between the second spring element and the cylinder head, wherein the bushing is coupled to or in contact with the second spring element such that the bushing is configured to transfer a force from the second spring element to the cylinder head.

11. The combustion engine of claim 10, wherein a distance element is arranged axially between the first spring element and the second spring element.

12. The combustion engine of claim 11, wherein the distance element is shaped as a sleeve and is at least partially arranged inside the through hole, and the shank portion is at least partially arranged inside the distance element.

13. The combustion engine of claim 12, wherein a first retaining element is arranged inside the distance element and is in engagement with the shank portion.

14. The combustion engine of claim 13, wherein the first retaining element comprises a plastic.

15. The combustion engine of claim 10, wherein the bushing is fixedly coupled to the second spring element.

16. The combustion engine of claim 10, wherein a retaining element is arranged inside the bushing and is engaged with the shank portion.

17. The combustion engine of claim 16, wherein the retaining element comprises a plastic.

18. The combustion engine of claim 10, wherein the fastening element is a screw.

19. The coupling device of claim 6, wherein the bushing is welded to the second spring element.

20. The combustion engine of claim 15, wherein the bushing is welded to the second spring element.

* * * * *